US009410671B2

(12) United States Patent
Lee et al.

(10) Patent No.: US 9,410,671 B2
(45) Date of Patent: Aug. 9, 2016

(54) HEAD LAMP FOR VEHICLE

(71) Applicant: Hyundai Motor Company, Seoul (KR)

(72) Inventors: Ki Hong Lee, Whasung-Si (KR); Jong Sik Bae, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 46 days.

(21) Appl. No.: 14/559,712

(22) Filed: Dec. 3, 2014

(65) Prior Publication Data

US 2015/0276160 A1 Oct. 1, 2015

(30) Foreign Application Priority Data

Mar. 27, 2014 (KR) ..... 10-2014-0035655

(51) Int. Cl.
*F21S 8/10* (2006.01)

(52) U.S. Cl.
CPC ..... *F21S 48/145* (2013.01); *F21S 48/125* (2013.01); *F21S 48/1258* (2013.01); *F21S 48/137* (2013.01); *F21S 48/1317* (2013.01)

(58) Field of Classification Search
CPC ..... F21S 48/125; F21S 48/137; F21S 48/145; F21S 48/1258; F21S 48/1317
See application file for complete search history.

(56) References Cited

U.S. PATENT DOCUMENTS

2009/0021942 A1* 1/2009 Kim ..... F21S 48/1258 362/268
2015/0308647 A1* 10/2015 Lee ..... F21S 48/1159 362/518

FOREIGN PATENT DOCUMENTS

| | | | |
|---|---|---|---|
| JP | 2002-117710 | B2 | 4/2002 |
| JP | 2012-216408 | A | 11/2012 |
| JP | 2013-187028 | A | 9/2013 |
| JP | 2013-200981 | A | 10/2013 |
| KR | 10-1181485 | B1 | 9/2012 |
| KR | 10-1195110 | B1 | 10/2012 |
| KR | 10-1295831 | B1 | 8/2013 |

* cited by examiner

*Primary Examiner* — Stephen F Husar
(74) *Attorney, Agent, or Firm* — Morgan, Lewis & Bockius LLP

(57) ABSTRACT

A head lamp for a vehicle may include a reflector coupled to a light source, and reflecting light emitted from the light source, a body coupled to the reflector, and disposed in front of the reflector, a lens coupled to the body, and disposed in front of the light source, a shield formed integrally with the body, positioned between the reflector and the lens, and shutting off a part of the light emitted from the light source which is reflected by the reflector, and a signal reflective surface formed integrally with an inner circumferential surface of the reflector, and reflecting the light emitted from the light source to an upper end portion of the lens.

5 Claims, 5 Drawing Sheets

HEAD LAMP FOR VEHICLE

CROSS-REFERENCE TO RELATED APPLICATION

The present application claims priority to Korean Patent Application No. 10-2014-0035655 filed Mar. 27, 2014, the entire contents of which is incorporated herein for all purposes by this reference.

BACKGROUND OF THE INVENTION

1. Field of the Invention

The present invention relates to a head lamp for a vehicle. More particularly, it relates to a head lamp for a vehicle which serves to improve sharpness of a cut-off line formed between a signal beam region and a low beam region of light emitted from the head lamp.

2. Description of Related Art

As well known, a head lamp for a vehicle is one of the essential components for safe driving, which illuminates a front side of a vehicle when the vehicle travels during the day and night, and simultaneously serves to give a warning to an oncoming vehicle on the opposite lane.

Referring to FIG. 1, a head lamp 10 in the related art includes a lens 11, a body 12 which is mounted on a rear side of the lens 11, a reflector 13 which is mounted on a rear side of the body 12, a light source 14 which is installed at the rear of the reflector 13, and a shield 15 and a signal plate 16 which are provided in the body 12.

According to the head lamp 10 in the related art, in the case of a low beam, light emitted from the light source 14 is reflected by the reflector 13, and thereafter, goes straight forward while passing through an opening portion 17 of the shield 15, and in the case of a signal beam, light emitted from the light source 14 is reflected by the reflector 13, and then passes through the opening portion 17 of the shield 15, and the light is reflected again by the signal plate 16, and then proceeds upward in a diagonal direction.

The low beam and the signal beam emitted from the head lamp mainly illuminate a predetermined region as illustrated in FIG. 2, and a boundary of light, that is, a cut-off line is formed between a low beam region illuminated by the low beam and a signal beam region illuminated by the signal beam due to the shield 15 disposed in front of the light source 14.

That is, a part of the light emitted from the light source 14 is shut off by the shield 15, and the remaining light, which is not shut off, exits through the lens 11, such that the cut-off line is formed between the low beam region and the signal beam region.

According to the head lamp 10 in the related art as described above, since the light reflected by the reflector 13 is reflected again by the signal plate 16, intensity of illumination of the light exiting the lens 11 is low, the signal beam region is narrow because a size of the signal plate 16 is small, and as a result, there is a problem in that there is a great difference in brightness between the low beam region and the signal beam region, and the cut-off line is clearly seen.

Therefore, in order to improve sharpness of the cut-off line, it is necessary to reduce the difference in brightness between the low beam region and the signal beam region.

However, the aforementioned head lamp 10 in the related art adopts an assembly structure in which the shield 15 and the signal plate 16 are separately manufactured, the signal plate 16 is attached to the shield 15, and the shield 15 is mounted in the body 12, and as a result, it is difficult to reduce the difference in brightness between the low beam region and the signal beam region because assembly dispersion among the shield 15, the signal plate 16 and the body 12 needs to be considered in addition to the design of the shield 15 and the signal plate 16.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a head lamp for a vehicle, capable of improving sharpness of a cut-off line formed between a signal beam region and a low beam region.

According to various aspects of the present invention, a head lamp for a vehicle may include a reflector coupled to a light source, and reflecting light emitted from the light source, a body coupled to the reflector, and disposed in front of the reflector, a lens coupled to the body, and disposed in front of the light source, a shield formed integrally with the body, positioned between the reflector and the lens, and shuts off a part of the light from the light source which is reflected by the reflector, and a signal reflective surface which is formed integrally with an inner circumferential surface of the reflector, and reflects the light emitted from the light source to an upper end portion of the lens.

The shield may include a center plate having a predetermined gradient at a center thereof, and one end of the center plate, which is directed toward the lens, may be positioned at a higher position than another end which is directed toward the light source.

An open portion, through which the light reflected by the signal reflective surface passes, may be formed at a lower portion of a center plate of the shield.

The shield may be formed at an opened rear side of the body so as to have a height equal to or less than a height of the light source, or have a height equal to or less than a height of a central axis of the light source.

The signal reflective surface may be formed in a shape having a curved surface with a predetermined curvature, and positioned below the light source.

The head lamp according to the present invention allows light to be reflected just once by the signal reflective surface formed integrally with the reflector so as to emit a signal beam such that light has a higher intensity of illumination than light reflected by a signal plate that is separately attached to the existing shield, and a size of the signal reflective surface may be adjusted to be greater than that of the existing signal plate such that the signal beam is emitted to an upper end of the low beam region, as a result, there is an effect in that a difference in brightness of light between the low beam region and the signal beam region may be reduced, sharpness of the cut-off line may be improved, and consumer complaints may be reduced.

According to various aspects of the head lamp for a vehicle of the present invention, the signal reflective surface is formed integrally with the reflector, and the shield is formed integrally with the body, thereby decreasing the number of components and material costs.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
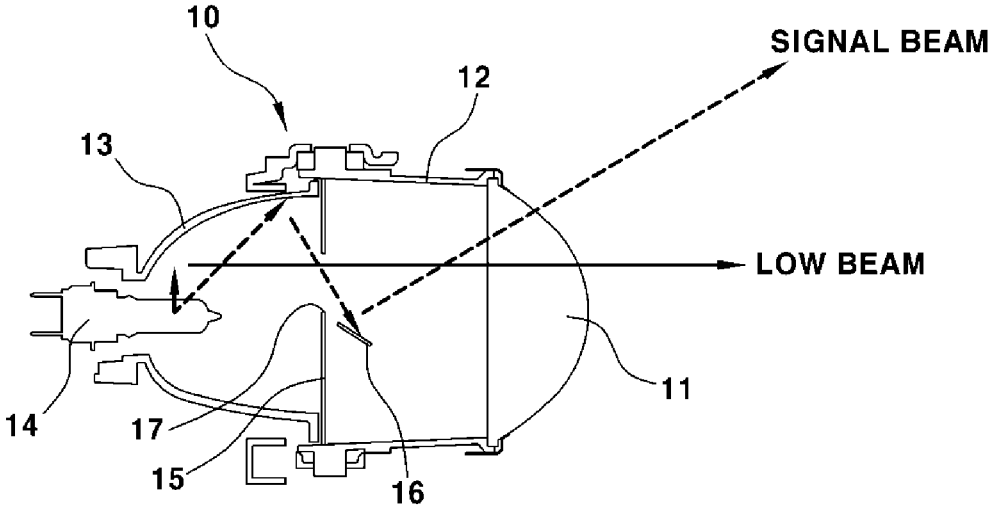
FIG. 1 (Related Art)
FIG. 1 is a cross-sectional view illustrating an exemplary head lamp in the related art.
Figure 2:
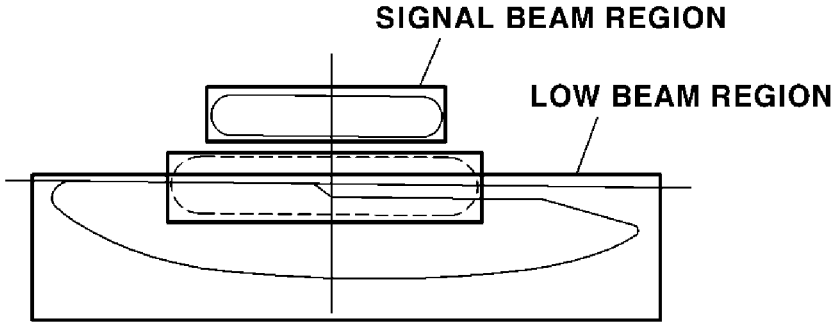
FIG. 2 (Related Art)
FIG. 2 is a view for explaining a cut-off line between a low beam region and a signal beam region illuminated by the head lamp in the related art.
Figure 3A:
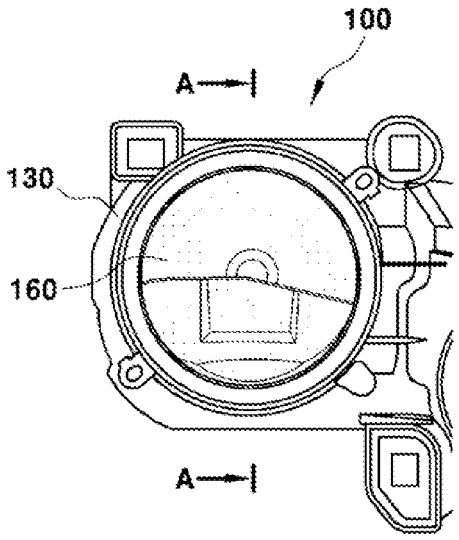
FIGS. 3A and 3B are front views illustrating an exemplary head lamp according to the present invention.
Figure 3B:
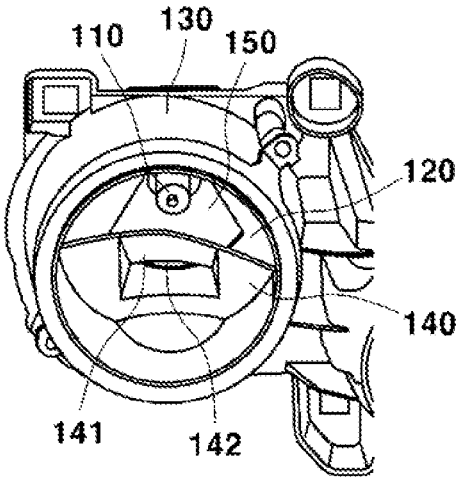

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As illustrated in FIGS. 3A, 3B, 4, 5A, 5B and 6, a head lamp 100 according to various embodiments of the present invention includes a light source 110, a reflector 120 which is coupled to the light source 110, a body 130 which is disposed in front of the reflector 120, a shield 140 which is formed integrally with the body 130, a signal reflective surface 150 which is formed integrally with the reflector 130, and a lens 160 which is coupled to the body 130.

The light source 110 emits light by being supplied with electric power, and emits light in a state in which the light source 110 is inserted into the reflector 130. For example, the light source 110 may be a directional light source that emits light in a predetermined direction.

The reflector 120 has a shape having a semi-circular curved surface with an opened side so as to reflect light emitted from the light source 110. For example, the reflector 120 may have a shape having an elliptical curved surface or a free curved surface, and one side of the light source 110, which is inserted into the reflector 120, may be positioned at a focal point of the reflector 120.

The body 130 may have an approximately cylindrical shape, be coupled to the reflector 120 by a connecting bracket 121, and be disposed in front of the reflector 120.

The connecting bracket 121, which has a shape that protrudes forward, is formed integrally with the reflector 120 at an edge of an opened front side that faces the body 130, and the reflector 120 is integrally connected to the body 130 by coupling the connecting bracket 121 to an edge of a rear side of the body 130.

The shield 140 is formed integrally with an opened rear side of the body 130, positioned between the reflector 120 and the lens 160 so as to shut off a part of light from the light source 110 which is reflected by the reflector 120, and forms a cut-off line between a low beam region and a signal beam region by shutting off a part of the light.

Figure 4:
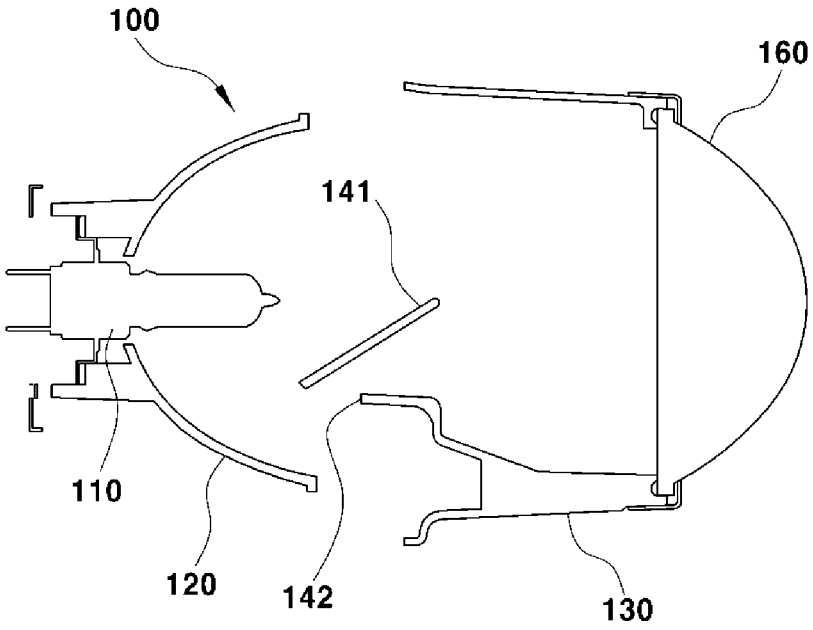
FIG. 4 is a cross-sectional view taken along line A-A of FIG. 3.
Figure 5A:
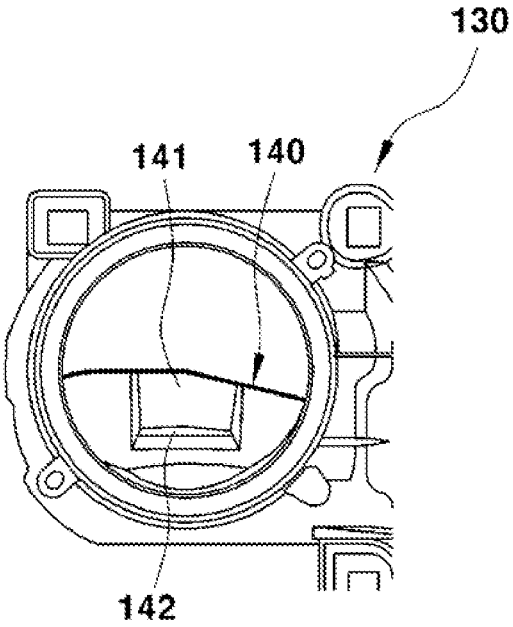
FIGS. 5A and 5B are views illustrating a body of the exemplary head lamp according to the present invention.
Figure 5B:
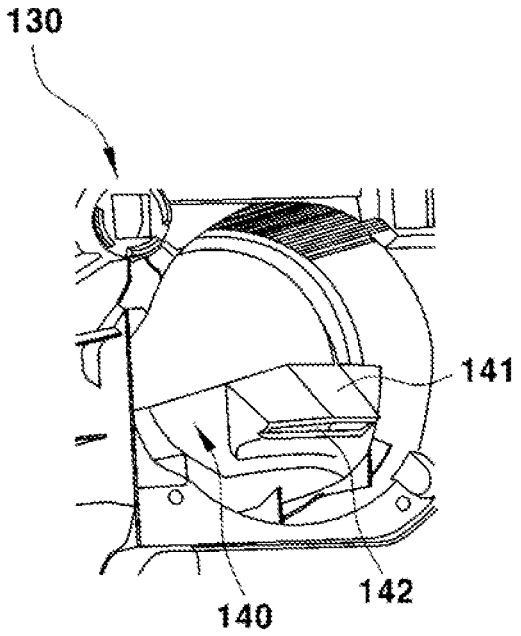

As illustrated in FIGS. 4, 5A and 5B, a plate-shaped center plate 141 having a predetermined gradient is formed at a center of the shield 140, and one end of the center plate 141 which is directed toward the lens 160 is positioned at a higher position than the other end which is directed toward the light source 110.

An open portion 142 through which light reflected by the signal reflective surface 150 passes is formed at a lower portion of the center plate 141 of the shield 140.

The shield 140 is formed to be disposed at the opened rear side of the body 130 so as to have a height equal to or less than a height of the light source 110, or have a height equal to or less than a height of a central axis of the light source 110.

That is, most of a lower end portion of the opened rear side of the body 130 is blocked by the shield 140 such that light cannot pass therethrough, and light passing through an upper end portion of the rear side is directed to a lower end portion of the lens 160.

Figure 6:
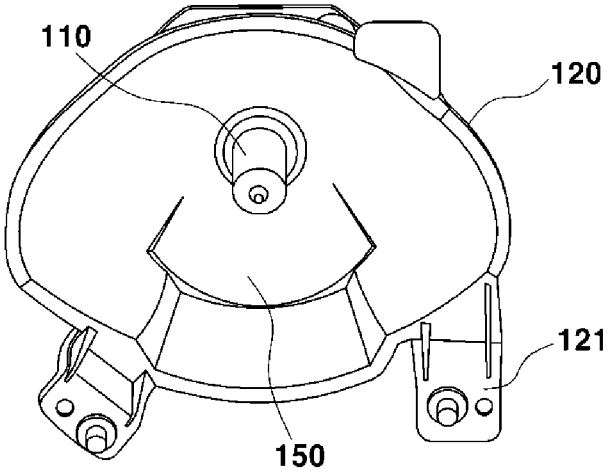
FIG. 6 is a view illustrating a reflector of the exemplary head lamp according to the present invention.

As illustrated in FIG. 6, the signal reflective surface 150 is formed integrally with an inner circumferential surface (a reflective surface) of the reflector 120 so as to reflect a part of light emitted from the light source 110 toward an upper end portion of the lens 160, and formed in an approximately fan-shaped region on the basis of the light source 110.

The signal reflective surface 150 is formed in a shape having a curved surface with a predetermined curvature, and positioned below the light source 110. The light reflected by the signal reflective surface 150 passes through the open portion 142, and then proceeds toward the upper end portion of the lens 160.

The lens 160 projects the light reflected by the reflector 120 to the outside of the head lamp 100, is mounted on a front side of the body 130, is disposed in front of the light source 110, and may be a convex lens type aspherical lens, but the present invention is not limited thereto.

A proceeding direction of light may be changed when light entering the lens 160 is refracted by the lens 160. For example, when a region of the lens 160 is divided into an upper hemisphere region and a lower hemisphere region on the basis of a front spherical surface of the lens 160, light, which horizontally enters the lower hemisphere region, may be refracted by the lens 160 and diverge upward, and light, which horizontally enters the upper hemisphere region, may be refracted by the lens 160 and diverge downward.

Hereinafter, a movement route and an illumination range of light when the head lamp 100 is turned on will be described with reference to FIGS. 7 and 8.

Figure 7:
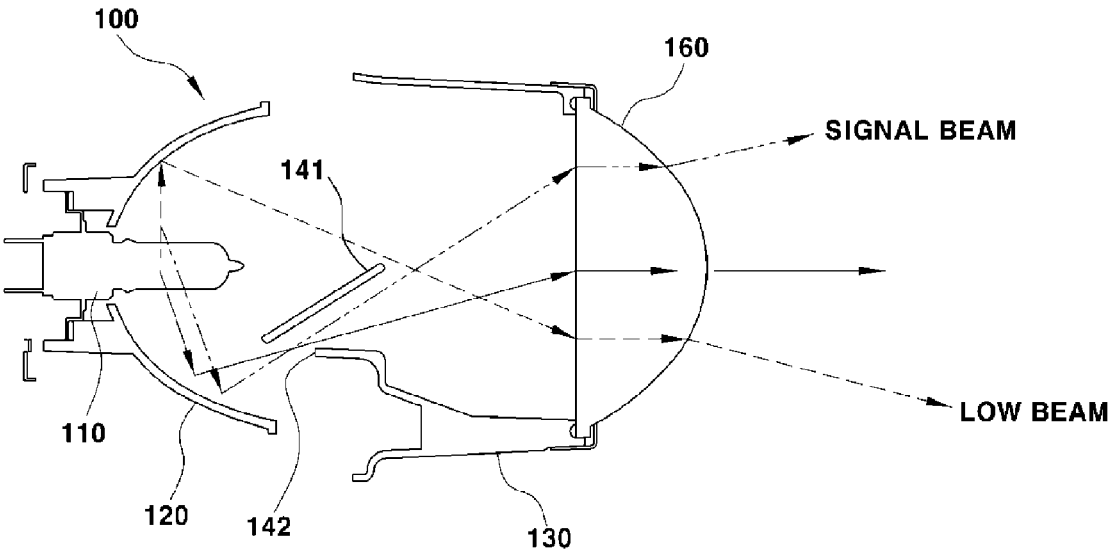
FIG. 7 is a view for explaining an operating state when the exemplary head lamp is turned on, according to the present invention.

As illustrated in FIG. 7, light emitted from the light source 110 of the head lamp 100 may be reflected at an inner circumferential surface of the reflector 120, may pass through the body 130, and may enter the lens 160.

Specifically, a part of the light emitted from the light source 110 is reflected by the signal reflective surface 150, passes through the open portion 142 of the shield 140, and enters the lens 160, and the light entering the lens 160 exits as a signal beam through the upper hemisphere region of the lens 160.

The light reflected at the inner circumferential surface of the reflector 120 except for the signal reflective surface 150 passes through the upper end portion of the rear side of the body 130, that is, an upper side of the shield 140, and enters the lens 160, and the light entering the lens 160 exits as a low beam through the lower hemisphere region of the lens 160.

Figure 8:
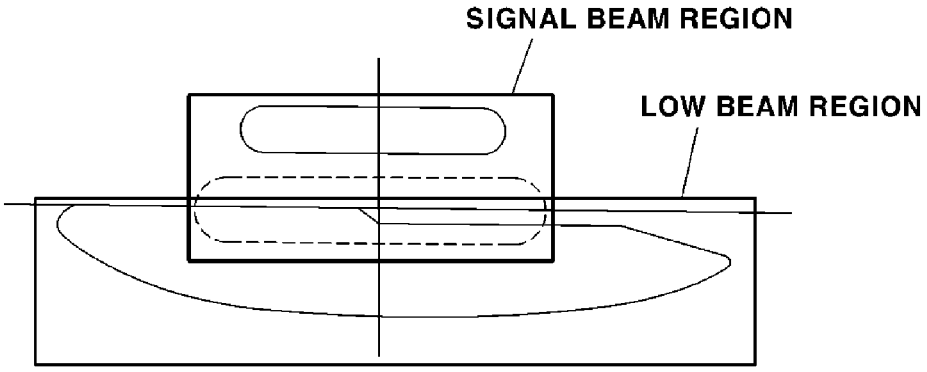
FIG. 8 is a view for explaining an effect of improving sharpness of a cut-off line between a low beam region and a signal beam region when the exemplary head lamp is turned on, according to the present invention.

In a case in which the light exiting the head lamp 100 is projected on a screen, the signal beam region is partially superimposed on an upper end portion of the low beam region, as illustrated in FIG. 8.

The head lamp 100 allows light to be reflected just once by the signal reflective surface 150 formed integrally with the reflector 120 so as to emit a signal beam such that light has a higher intensity of illumination than light reflected by a signal plate that is separately attached to the existing shield, and a size of the signal reflective surface 150 may be adjusted to be greater than that of the existing signal plate such that the signal beam is emitted to an upper end of the low beam region, as a result, there is an effect in that a difference in brightness of light between the low beam region and the signal beam region may be reduced, and sharpness of the cut-off line may be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A head lamp for a vehicle, comprising:

a reflector coupled to a light source, and reflecting light emitted from the light source;

a body coupled to the reflector, and disposed in front of the reflector;

a lens which coupled to the body, and disposed in front of the light source;

a shield formed integrally with the body, positioned between the reflector and the lens, and shutting off a part of the light emitted from the light source which is reflected by the reflector; and a signal reflective surface formed integrally with an inner circumferential surface of the reflector, and reflecting the light emitted from the light source to an upper end portion of the lens.

2. The head lamp of claim 1, wherein the shield includes a center plate having a predetermined gradient at a center thereof, and one end of the center plate, directed toward the lens, is positioned at a higher position than another end which is directed toward the light source.

3. The head lamp of claim 1, wherein an open portion, through which the light reflected by the signal reflective surface passes, is formed at a lower portion of a center plate of the shield.

4. The head lamp of claim 1, wherein the shield is formed at an opened rear side of the body so as to have a height equal to or less than a height of the light source, or have a height equal to or less than a height of a central axis of the light source.

5. The head lamp of claim 1, wherein the signal reflective surface is formed in a shape having a curved surface with a predetermined curvature, and positioned below the light source.

* * * * *